US006138863A

United States Patent [19]

Aiken

[11] Patent Number: 6,138,863

[45] **Date of Patent: *Oct. 31, 2000**

[54] MULTIPURPOSE CONTAINER

[75] Inventor: Cynthia R. Aiken, Lawrenceville, Ga.

[73] Assignee: Rehrig Pacific Company, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/240,568

[22] Filed: Jan. 29, 1999

[51] Int. Cl.[7] ..... B65D 51/04

[52] U.S. Cl. ..... 220/819; 220/817; 220/831; 220/836; 220/837; 220/840; 206/506; 206/508

[58] Field of Search ..... 220/817, 818, 220/819, 821, 824, 826, 831, 836, 837, 839, 840; 206/505, 506, 508, 517, 519

[56] References Cited

U.S. PATENT DOCUMENTS

| | | | |
|---|---|---|---|
| D. 241,777 | 10/1976 | Allman et al. . | |
| D. 384,582 | 10/1997 | Cain . | |
| 2,953,244 | 9/1960 | Phillips . | |
| 4,143,695 | 3/1979 | Hoehn . | |
| 4,161,261 | 7/1979 | Frater . | |
| 4,391,386 | 7/1983 | Moret | 220/819 |
| 4,412,616 | 11/1983 | Williams . | |
| 4,467,939 | 8/1984 | Warwick | 220/819 |
| 4,685,567 | 8/1987 | Webb . | |
| 4,765,480 | 8/1988 | Malmanger . | |
| 5,088,616 | 2/1992 | Susko et al. . | |
| 5,253,758 | 10/1993 | Bissell, II . | |
| 5,294,413 | 3/1994 | Riihimaki et al. . | |
| 5,330,069 | 7/1994 | Jamison et al. | 220/819 |
| 5,392,915 | 2/1995 | Kalin . | |
| 5,415,293 | 5/1995 | Ackermann et al. . | |
| 5,555,996 | 9/1996 | Lang-Ree et al. . | |
| 5,673,791 | 10/1997 | Jamison . | |
| 5,992,673 | 11/1999 | Hwang . | |
| 6,036,049 | 3/2000 | Hwang . | |

OTHER PUBLICATIONS

Paxton Brochure, p. 10 (Undated but believed to be prior art).

*Primary Examiner*—Stephen K. Cronin
*Attorney, Agent, or Firm*—Brooks & Kushman P.C.

[57] ABSTRACT

A multipurpose container having a lid and a receptacle. The receptacle has a base, a pair of side walls and a pair of end walls. The side walls are opposing each other and are integral to the base and to each other. At least one container wall has one half of a hinge mechanism integrally molded to a free end which mates with the other half of the hinge mechanism integrally molded with the lid to for the hinge mechanism. The hinge mechanism removably and pivotally attaches the lid to the receptacle. The hinge prevents the lid from rotating past a prescribed angle while allowing the lid to remain open to aid in filling the container. The lid includes a living hinge which allows the lid to be reduced in size and fit within the container. The container is adapted to being stackable and nestable when the lid is removed and placed inside the container.

7 Claims, 9 Drawing Sheets

MULTIPURPOSE CONTAINER

TECHNICAL FIELD

This invention relates to a multipurpose container for the storage and transport of food items, including seafood, produce and other goods.

BACKGROUND ART

Containers or crates are commonly used to transport and store a variety of items. Such crates are typically formed of injection molded plastic and are frequently adapted to receive perishable food items. Typically, rectangular in shape the containers have a flat base surrounded by four upstanding side panels which are integral with the base. Additionally, a container lid is provided to allow the containers to be stacked upon each other, without damaging the stored goods, when food items or other goods are stored within the containers.

In such containers, the container lids are typically secured to the container via hinges. The hinges are generally located along the long edge of the container lid and removably secure the lid to the container. The lid may be released or disengaged from the container when it is rotated to a prescribed position relative to the container. Such container lids require lifting and holding the lid open to load the container with goods. If the container lid is not held open and allowed to drop to a fully open position it may become disengaged from the container as the lid reaches the prescribed hinge disengagement position. Disengagement after or during loading of the containers decreases the efficiency of the container loading process. After the containers have been emptied of the transported goods the containers must be stored for later use. Accordingly, in an effort to conserve storage space the containers are stacked and nested within each other. However, the container lids must first be removed so that the containers may nest inside each other. The separation of the container lids and the container can result in a misplacement of the lids and further hinder the loading and transportation of goods.

Consequently, there is a need for an improved container which includes a lid which can be propped open to facilitate loading the container with goods. Furthermore, it is desirable to have a container with a lid which is capable of being disengaged from the container and stored within the container to prevent misplacement of the container lid. The container should be stackable and nestable with the container lid.

SUMMARY OF THE INVENTION

It is an object of the present invention to provide a container lid which is removable from the container.

It is another object according to the present invention to provide a container which includes a rib stop for engaging the container lid and preventing it from rotating past a prescribed angle.

It is still another object according to the present invention to provide a container having a container lid which may be disengaged from the container and stored within the container for stacking and nesting purposes.

Moreover, it is an object according to the present invention to provide a container and a container lid which is able to nest with like containers wherein the container lid is disengaged from the container and stored within the container, for stacking and storage purposes.

Accordingly, a multipurpose container for transporting and storing items is provided. The container comprises a receptacle and a lid. The receptacle has a pair of opposed side walls, a pair of opposed end walls, and a base. The side walls include an upper free edge. The pair of opposed side walls and end walls are integrally molded to the base. The base further includes a cylindrical member and at least one rib integrally molded to the upper edge of at least one side wall. The lid is removably and pivotably attached to the receptacle. The lid has edges on the periphery of the lid, the lid further includes a living hinge and a plurality of projections. The living hinge allows the lid to fold onto itself thus reducing its overall size and enabling the folded lid to lie flat on the base of the container. The plurality of projections are integrally molded to the edge of the lid. The projections are configured to engage the cylindrical member to form a hinge mechanism. At least one projection engages at least one rib thereby prevents the lid from rotating past a prescribed angle. In this configuration the lid may be propped open when the container is being filled. When the container is emptied and desired to be stored the lid may then be disengaged from the receptacle and placed within the container. The container is configured to be stackable and nestable when the lid is placed inside the container.

The above objects and other objects, features, and advantages of the present invention are readily apparent from the following detailed description of the best modes for carrying out the invention when taken in connection with the accompanying drawings.

BEST MODE FOR CARRYING OUT THE INVENTION

Figure 1:
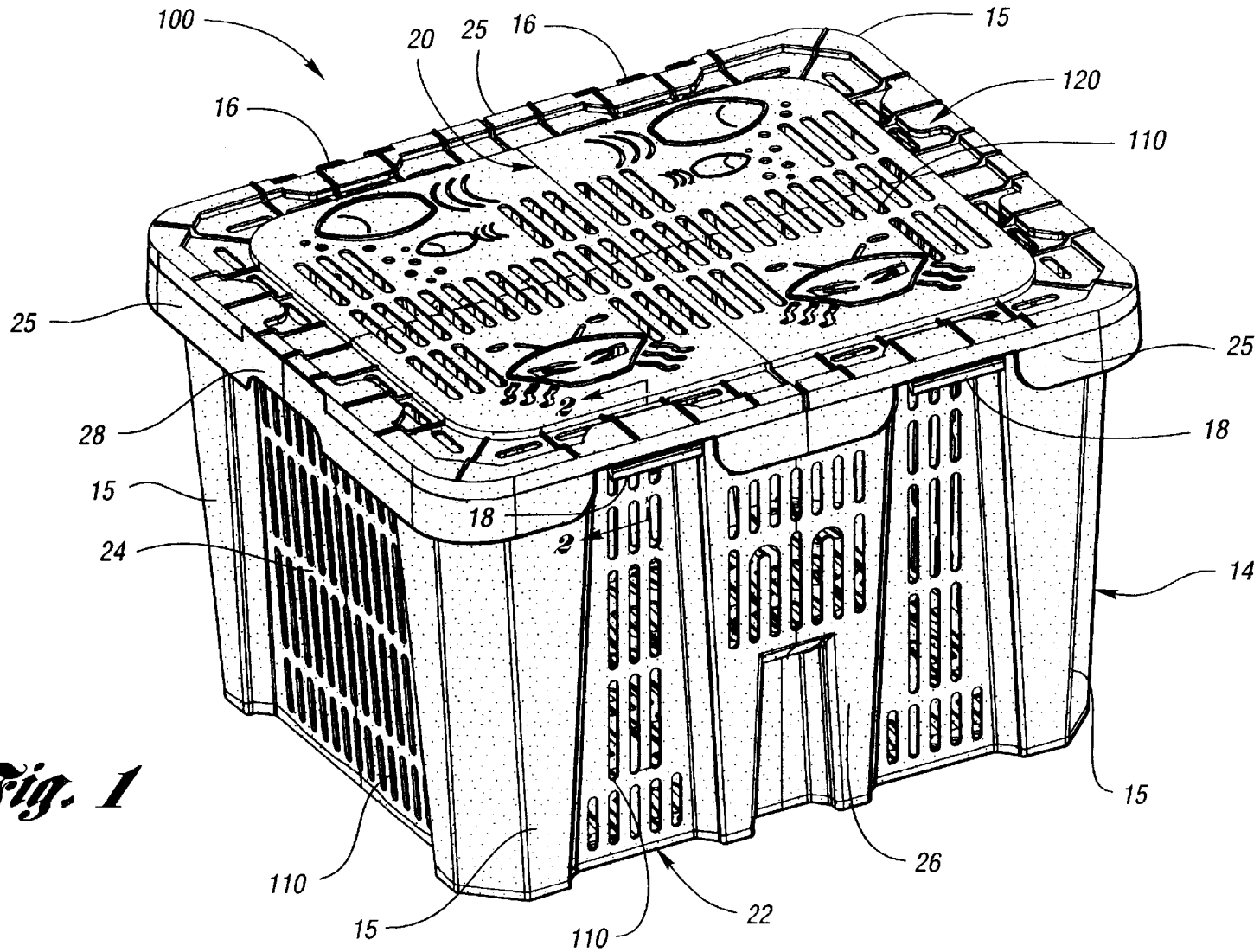
FIG. 1 of the drawings is a perspective view the container according to the present invention.

With reference to FIG. 1 of the drawings, there is illustrated a container 100 made in accordance with the teachings of the present invention. Container 100 and its component parts are typically formed of plastic or polymeric material via injection molding or other plastic molding process suitable to this application. Container 100 may be used for storage or transport of goods, and may also be referred to as a crate. Container 100 is particularly suitable for transport of seafood such as crabs and fish, where circulation of air and/or refrigeration gas is necessary to keep the seafood fresh and consumable during transportation to the market. This circulation is fostered through the plurality of slots 110 provided on each surface over the entire container, as fully shown in FIGS. 1 and 4.

Container 100 includes a lid 120 and a receptacle 14. Receptacle 14 has a base 22 which serves as the lower support for the receptacle 14. The base 22 is generally rectangular in shape. Receptacle 14 further includes a pair of integrally molded upstanding ends 24 and a pair of integrally molded upstanding sides 26 (or receptacle walls) oriented outwardly at an angle slightly greater than 90 degrees relative to the a base 22. The outwardly slanting ends and sides enable the crates to nest within each other when the lid is removed and they are stacked. More specifically, the upstanding ends 24 are mirror opposites of each other and are disposed across a long end of the base 22 and accordingly, the upstanding sides 26 are mirror opposites and are disposed across a short end of the base 22. Additionally, the upstanding ends 24 and sides 26 are bounded by an upper edge 25. As is well understood in the art, the wall thickness of each of the walls and components illustrated and disclosed herein may vary depending on the intended usage and other characteristics desired from container 100.

Receptacle 14 further includes four upstanding comer members 15 situated, of course, at each comer of the base 22. As with the upstanding sides and ends, each comer member 15 is preferably integrally molded to the base 22 and to upstanding ends 24 and sides 26 and are outwardly slanted to facilitate nesting of the containers 100. Each upstanding end 24 contains an integrally molded handle 28 located at the upper edge 25. The handles 28 are provided to assist in carrying the container 100.

With continuing reference to FIG. 1, container 100 is illustrated having a lid 120. Lid 120 includes a pair of hinge mechanisms 16 and a pair of locking blocks 18. Hinge mechanisms 16 allow the lid to be removable and rotatable about the upper edge 25 of the receptacle 14. Locking blocks 18 releaseably secure the lid in the closed position to the receptacle 14 as shown in FIG. 1. Lid 120 further includes a living hinge 20 which allows the lid to fold onto itself as better shown in FIG. 9.

Figure 2:
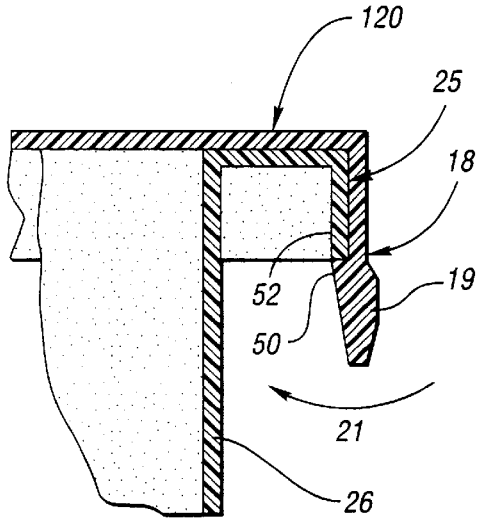
FIG. 2 is a cross-section through a locking block which locks the lid to the receptacle when the lid is in the closed position as shown, according to the present invention.

Reference is now made to FIG. 2, which is a cross-section cut through the locking blocks 18, at a location as indicated by the arrows 2—2 in FIG. 1. The locking block 18, shown in a locked position, and is integrally molded to the lid 120. Additionally, the lid 120 has a rotatable free end 19. The locking block 18 includes a clip portion 50 located at the free end 19. The clip portion extends longitudinally along the locking block 18 and engages the upper edge 25 of the upstanding side 26. More specifically, the upper edge 25 includes a rim portion 52 which engages the clip portion 50. The rim portion 52 and clip portion 50 engagement is provided through an interference fit of the two components. Additionally, the free end 19 is rotationally biased in the direction as indicated by the arrow 21 further promoting the engagement of the clip portion 50 and the rim portion 52. In operation, the lid is closed and locked by moving the lid 120 from a fully open position (as shown in FIG. 4) to a closed position (as shown in FIG. 1) and pressing downwardly on the lid until the clip portion 50 has engaged the rim portion 52.

Figure 3:
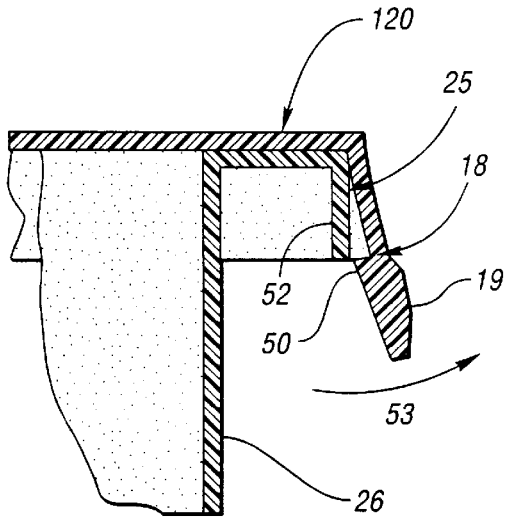
FIG. 3 is a cross-section through the locking block illustrating the locking block disengaged from the receptacle, according to the present invention.

Reference is now made to FIG. 3, which is a cross-section cut through the locking blocks 18, at the same location as in FIG. 2. The locking block 18 is shown in an unlocked position. The locking block is positioned in the unlocked position by rotating the free end 19 in a direction as indicated by the arrow 53. In the unlocked position the clip portion 50 is disengaged from the rim portion 52. When the free end 19 is rotated such that the clip portion 50 is disengaged from the rim portion 52 the lid 120 is unlocked and my be rotated to an open position (as shown in FIG. 4) to facilitate loading or unloading of goods.

Figure 4:
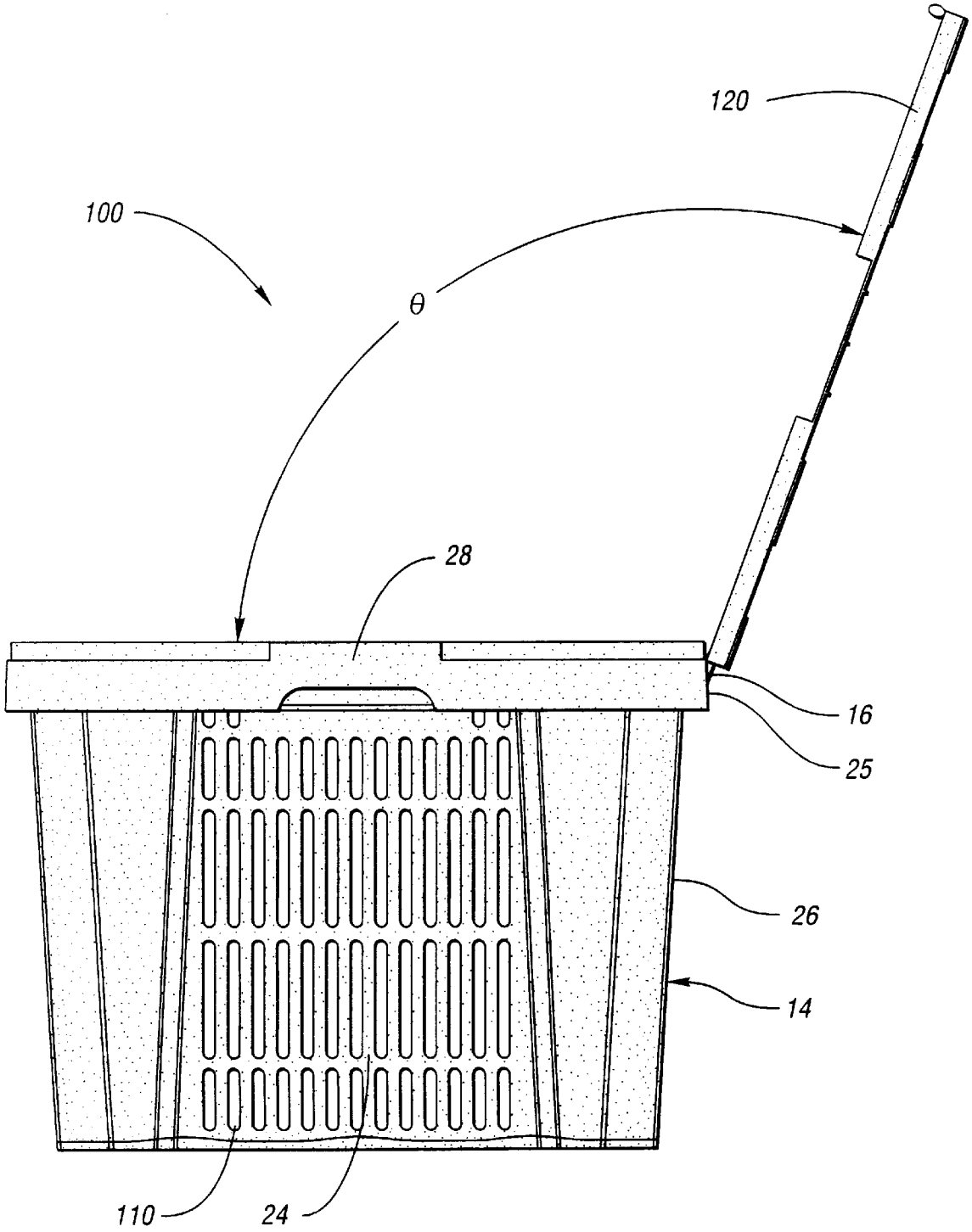
FIG. 4 of the drawings is a perspective view of the container with the lid in the fully open position according to the present invention.

Reference is now made to FIG. 4, which illustrates the container 100 with the lid 120 in a fully opened position. In the fully opened position the receptacle 14 is fully accessible and is easily loadable. The lid 120 remains rotationally engaged with the upper edge 25 of the side wall 26. Further, the lid is prevented from rotating beyond an angle theta ($\theta$) of approximately 110° by the interaction of the hinge mechanism 16 as described in detail below.

Figure 5:
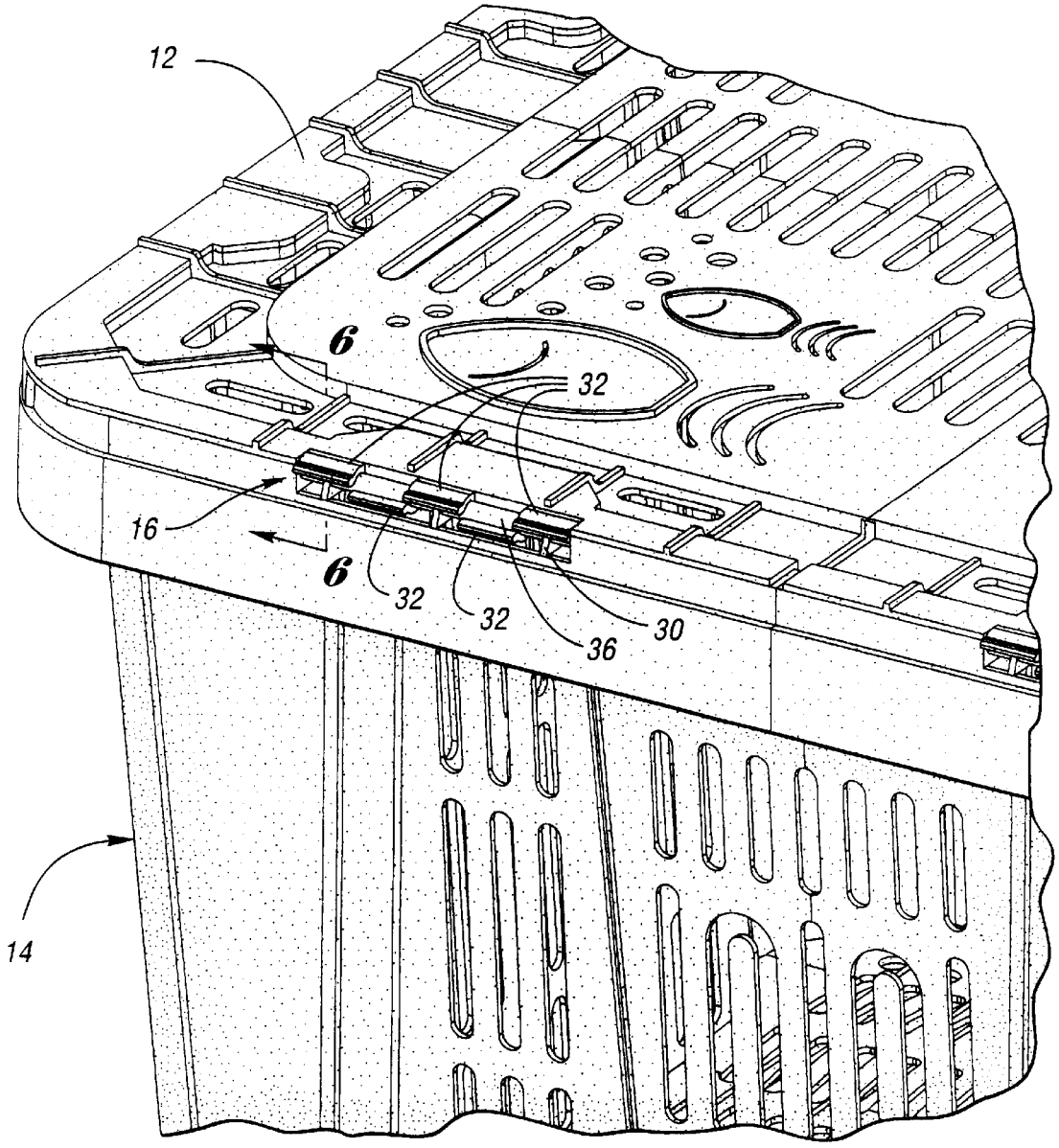
FIG. 5 is an enlarged perspective view of the hinge mechanism which pivotally secures the lid to the receptacle according to the present invention.

Referring now to FIG. 5, a more detailed view of the hinge mechanism 16 is illustrated. The hinge mechanism 16 includes a cylindrical member 36, a plurality of alternately spaced finger-like projections 32, and a plurality of ribs 30. The cylindrical member 36 as well as the ribs 30 are integrally molded to the receptacle 14. The projections 32 are flexible and have arcuate surfaces which meet and spring toward the cylindrical member 36 allowing the lid 120 to be engagable and removable from the receptacle 14. Further, the projections are positioned on the lid 120 adjacent one another but on opposite sides of the cylindrical member 36 in an alternating fashion. The ribs 30 are positioned under each alternately spaced projection 32. The ribs 30 are configured, as described below, to prevent the lid 120 from rotating past a prescribed angle $\theta$ as shown in FIG. 6.

Figure 6:
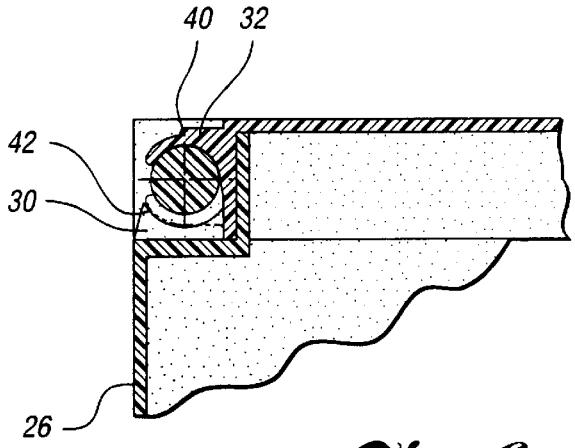
FIG. 6 is a cross-section through the hinge and illustrates the rib which prevents the lid from rotating past a prescribed angle according to the present invention.

In FIG. 6 a cross-section through the hinge 16 as indicated by the arrows 6—6 of FIG. 5 is illustrated. Projections 32 have a flat portion 40 which extends transversely cross each of the projections. The ribs 30 are integrally molded to the upper edge of the side wall 26 which is opposite the side wall having the rim portion 52. The ribs 30 includes a flat end 42 which is configured to engage the flat portion 40 on the projections 32 when the lid 120 is rotated to the predefined angle $\theta$ as will be described in more detail below.

Figure 7:
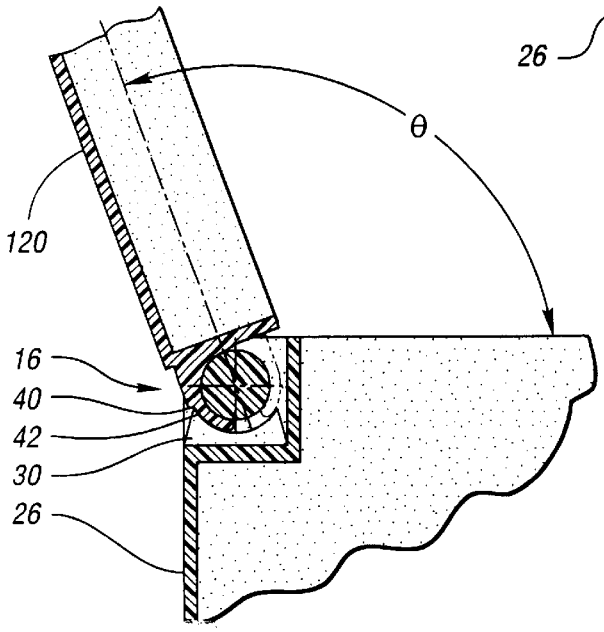
FIG. 7 is a cross-section at the same point as shown in FIG. 6 and illustrates the lid in the fully open position at the point at which the lid is prevented from rotating according to the present invention.

FIG. 7 illustrates, a cross-section through the hinge mechanism 16 as indicated by the arrows 7—7 of FIG. 5. The lid 120 is rotated by an angle $\theta$ which corresponds to the lid being fully opened whereby the base is accessible for loading or unloading of goods. The angle $\theta$ is generally between 90° and 110°. The lid 120 is held open at the angle $\theta$ under the force of gravity and by the interaction of the flat portion 40 with the flat end 42 of the rib 30. When the lid 120 is in the position as shown in FIG. 4 it is pivotally secured to the cylindrical member 36 and will not move to the closed position as shown in FIG. 1 without being acted on by an operator. In this way, the present invention allows container 100 to be loaded or unloaded without the operator having to hold the lid 120 in the open position. Further, the lid 120 will remain engaged to the receptacle 14 until the projections 32 are disengaged from the cylindrical member 36 providing a more efficient loading and unloading process.

Figure 8:
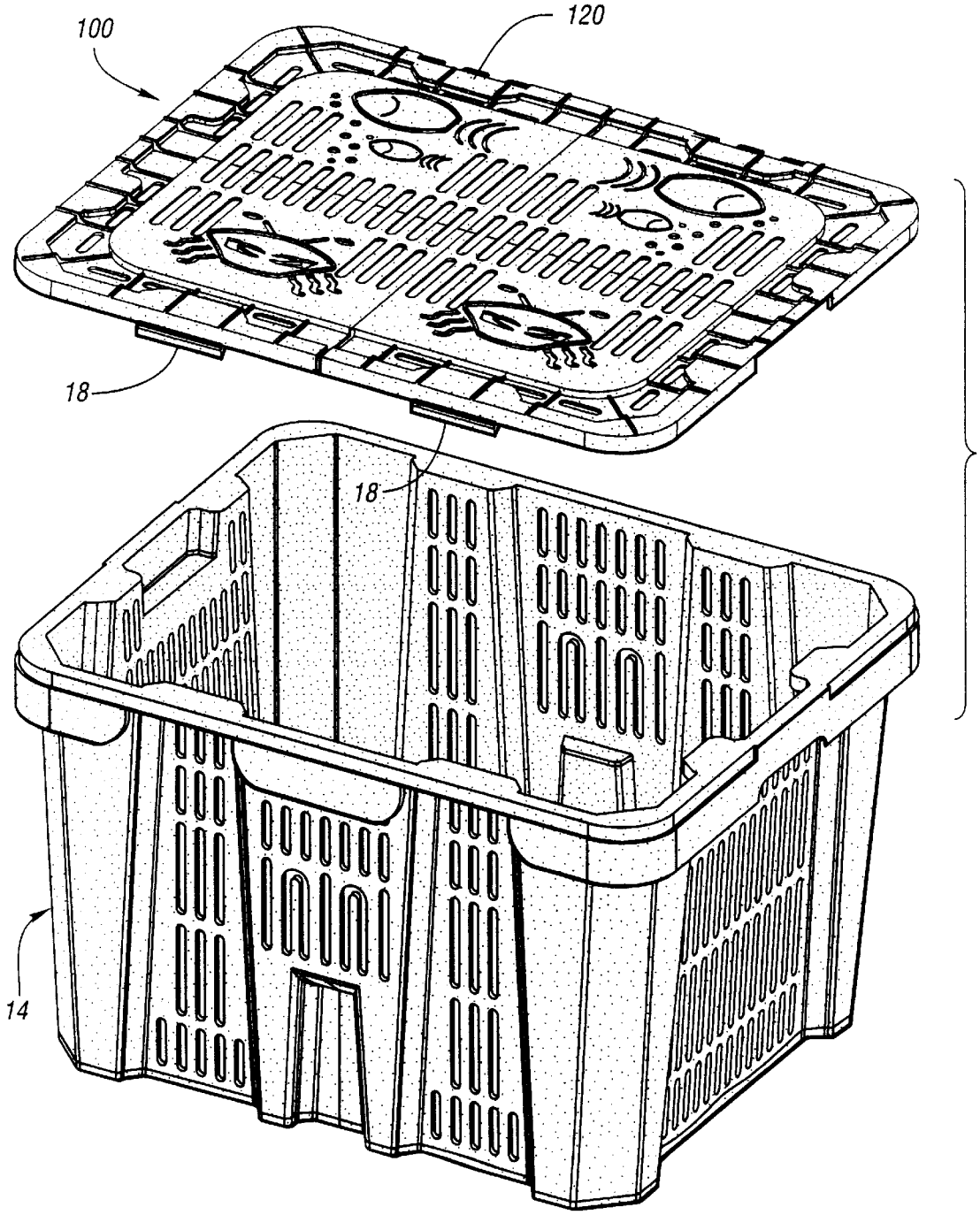
FIG. 8 of the drawings is a perspective view of the container with the lid disengaged from the receptacle according to the present invention.

Referring now to FIG. 8, the container 100 is shown with the lid 120 disengaged from the receptacle 14. In operation the container 100 is prepared for storage by unlocking the locking blocks 18 as previously described and then rotating the container lid 120 to a lid disengagement angle (not shown), preferably between 10° and 90°, at which point the lid 120 may be disengaged from the receptacle 14. The lid 120 is disengaged from the receptacle 14 by pulling the lid in a direction away from the cylindrical member 36 until the projections 32 release the cylindrical member 36. Upon disengagement the lid 120 may be folded upon itself reducing the size of the lid by at least one-half of its original size as shown in FIG. 9.

Figure 9:
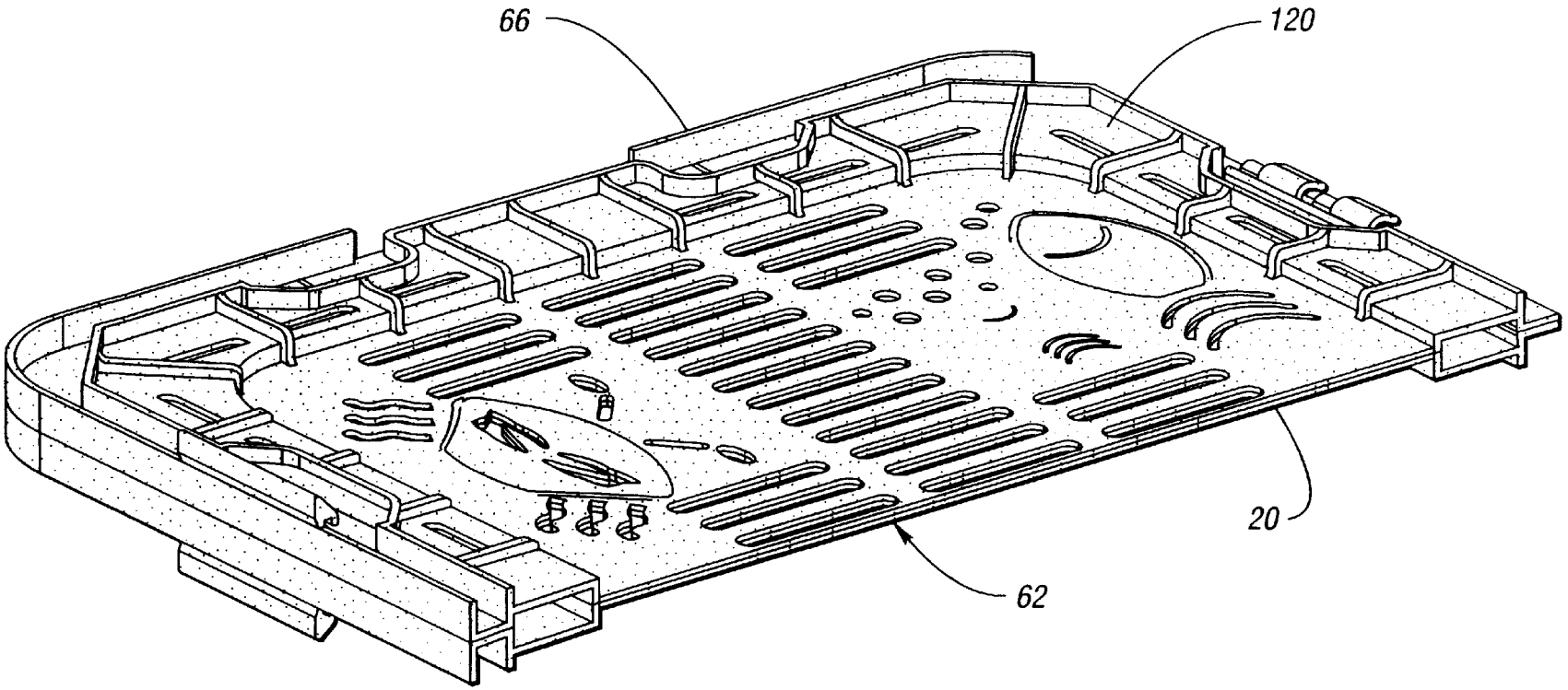
FIG. 9 of the drawings is a perspective view of the lid folded in half along the living hinge according to the present invention.
Figure 10:
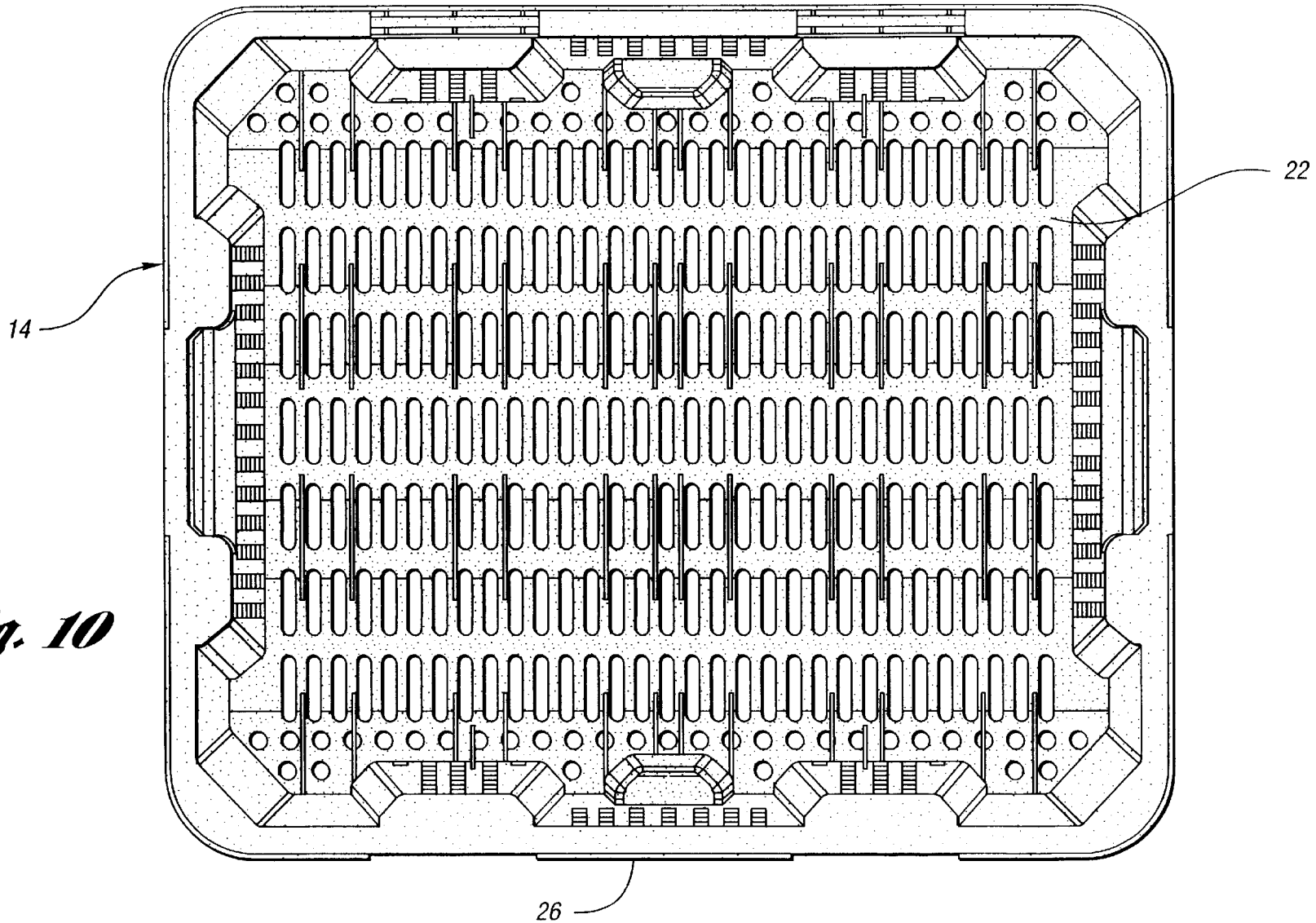
FIG. 10 of the drawings is a plan view of the receptacle before the folded lid is loaded into the receptacle and placed on the base according to the present invention.

Referring now to FIGS. 9 and 10, the lid 120 is shown folded along the living hinge 20. The living hinge 20 is integrally molded to the lid 120 and extends along the short length 62 of the lid 120. Once the lid 120 is folded it occupies an area half the size of the area that the lid originally occupied. The folded lid 120 is now able to lie flat on the base 22 within the receptacle 14. The folded lid 120 is placed in the receptacle 14 by orienting the long side 66 of the folded lid 120 such that the long side 66 is parallel with the side wall 26 of the receptacle 14.

Figure 11:
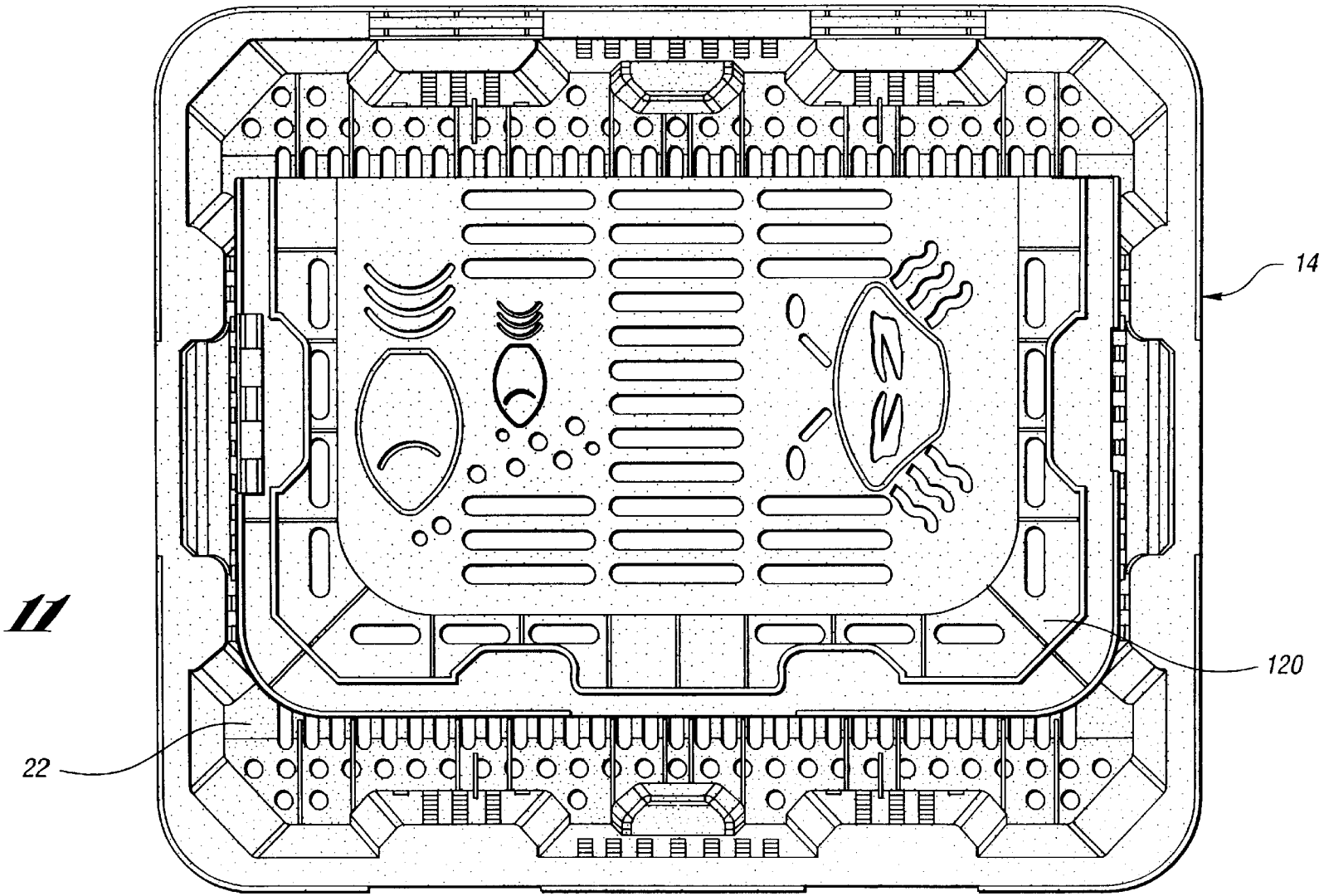
FIG. 11 of the drawings is a plan view of the container with the lid positioned within the receptacle and lying flat on the base according to the present invention.

Moreover, FIG. 11 illustrates the folded lid 120 lying flat on the base 22 of the receptacle 14. The present invention prevents misplacement of the lid from the receptacle 14 since the lid is storable within the receptacle 14. Furthermore, the compactness of the receptacle/folded lid arrangement allows the containers 100 to be nested and stacked thus reducing the overall storage space required to house the unused containers (as shown in FIG. 12).

Figure 12:
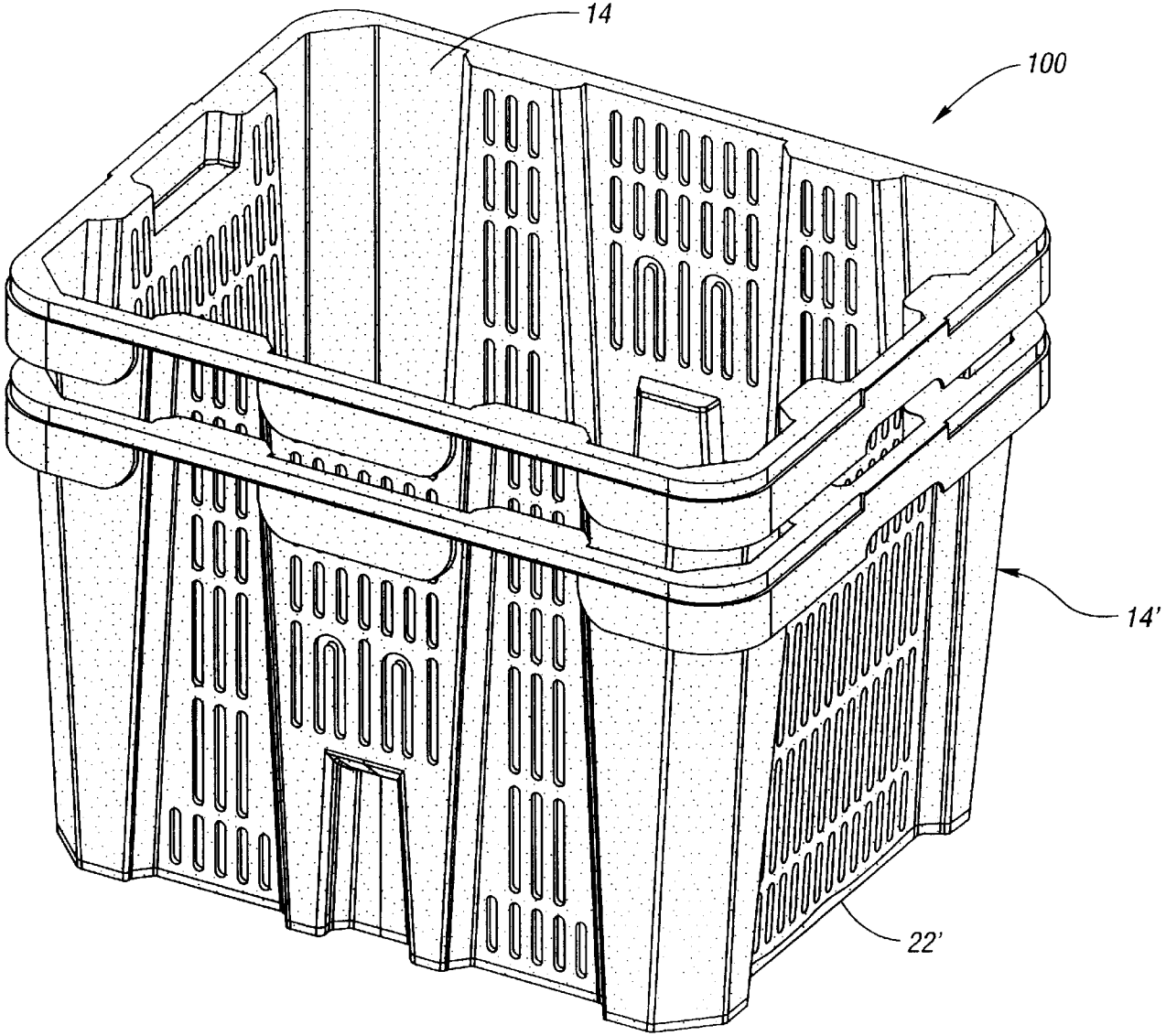
FIG. 12 of the drawings is a perspective view of two containers with the lid positioned within the receptacle stacked and nested for storage according to the present invention.

Referring now to FIG. 12, the container 100 having a folded lid 120 positioned within the receptacle 14 is shown in a nested and stacked configuration. Since the folded lid 120 is able to lie in a compact manner on the base 22 the containers 100 are able to be stacked and nested such that a substantial portion of the receptacle 14 is positioned within another receptacle 14'0 having a folded lid 120 lying on its base 22'. The compact manner in which the containers 100 may be stacked conserves the space in which the unused containers are stored and allows many containers to be stored in a relatively small area.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A multipurpose container for transporting and storing items, the container comprising:

a receptacle including:

a base;

a pair of opposed side walls having a side upper edge;

a pair of opposed end walls having an end upper edge; and a cylindrical member and at least one rib secured to the side upper edge of at least one side wall, and a lid having a short length and a long length and bounded by an edge, the lid further including:

a living hinge extending across the short length which allows the lid to fold onto itself; and a plurality of projections attached to the edge of the lid, the projections are configured to engage the cylindrical member to form a hinge mechanism enabling the lid to rotate on the receptacle, and wherein at least one projection engages at least one rib thereby preventing the lid from rotating past a predefined angle.

2. The multipurpose container of claim 1 wherein the projections are adjacently spaced and opposing each other.

3. The multipurpose container of claim 1 wherein the projections have a flat surface portion which extend transversely across the projection and engage at least one rib.

4. The multipurpose container of claim 1 further comprising at least one locking block for securing the lid in a closed position.

5. The multipurpose container of claim 1 wherein the predefined angle has a range between 90° and 110°.

6. A multipurpose container for transporting and storing items, the container comprising:

a receptacle including:

a base;

a pair of opposed side walls having a side upper edge;

a pair of opposed end walls having an end upper edge; and a cylindrical member secured to the side upper edge of at least one side wall, and a lid having a short length and a long length and bounded by an edge, the lid further including:

a living hinge extending across the short length of the lid which allows the lid to fold onto itself; and a plurality of projections attached to the edge of the lid, the projections are configured to engage the cylindrical member to form a hinge mechanism enabling the lid to rotate on the receptacle.

7. The multipurpose container of claim 6 further comprising at least one rib secured to the side upper edge for limiting the rotation of the lid.

* * * * *